US010214032B2

(12) United States Patent
Matsuura et al.

(10) Patent No.: US 10,214,032 B2
(45) Date of Patent: Feb. 26, 2019

(54) PRINTING APPARATUS

(71) Applicant: CANON KABUSHIKI KAISHA, Tokyo (JP)

(72) Inventors: Masaaki Matsuura, Kawasaki (JP); Katsuyuki Yokoi, Yokohama (JP); Masateru Komori, Yokohama (JP); Masato Koshimizu, Kawasaki (JP); Tsuyoshi Saeki, Kawasaki (JP); Kyoshiro Okude, Kawasaki (JP); Yukimichi Kimura, Kawasaki (JP); Masahiro Kawanishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/612,034

(22) Filed: Jun. 2, 2017

(65) Prior Publication Data

US 2017/0361631 A1 Dec. 21, 2017

(30) Foreign Application Priority Data

Jun. 17, 2016 (JP) ..... 2016-121239

(51) Int. Cl.

| | |
|---|---|
| ***B41J 13/10*** | (2006.01) |
| ***B41J 11/58*** | (2006.01) |
| ***B41J 13/02*** | (2006.01) |

(52) U.S. Cl.

CPC ..... *B41J 11/58* (2013.01); *B41J 13/025* (2013.01); *B41J 13/103* (2013.01); *B41J 13/106* (2013.01)

(58) Field of Classification Search

CPC ..... B41J 11/58; B41J 11/0045; B41J 13/103; B41J 13/10

See application file for complete search history.

(56) References Cited

U.S. PATENT DOCUMENTS

| | | | | |
|---|---|---|---|---|
| 5,223,858 | A | 6/1993 | Yokoi et al. | |
| 5,793,399 | A | 8/1998 | Kawakami et al. | |
| 5,982,400 | A | 11/1999 | Yokoi et al. | |
| 6,092,893 | A | 7/2000 | Yokoi et al. | |
| 6,139,010 | A | 10/2000 | Yokoi | |
| 6,257,692 | B1 | 7/2001 | Yokoi et al. | |
| 6,793,425 | B2 | 9/2004 | Yoshikawa et al. | |
| 6,871,848 | B2 | 3/2005 | Matsushima et al. | |
| 9,132,670 | B2 | 9/2015 | Ishizuka et al. | |
| 2004/0141785 | A1* | 7/2004 | Kang | B41J 13/103 400/578 |
| 2011/0158725 | A1* | 6/2011 | Asada | B41J 3/60 399/397 |
| 2016/0052733 | A1 | 2/2016 | Taniguchi et al. | |

FOREIGN PATENT DOCUMENTS

| | | | |
|---|---|---|---|
| JP | 2014-156088 | A | 8/2014 |

* cited by examiner

*Primary Examiner* — Jason S Uhlenhake
(74) *Attorney, Agent, or Firm* — Venable LLP

(57) ABSTRACT

Provided is a printing apparatus enabling a user to easily perform jam processing. The printing apparatus includes a printing unit, a cassette in which a plurality of sheets to be printed by the printing unit are mounted, and which is capable of being drawn out from the device by a user, a roller pair which is capable of being in an abutting state and a separate state and transports the sheet supplied from the cassette by interposing the sheet, in the abutting state, and a mechanism which changes the roller pair from the abutting state to the separate state as the cassette is drawn out.

13 Claims, 10 Drawing Sheets

PRINTING APPARATUS

BACKGROUND OF THE INVENTION

Field of the Invention

The present invention relates to a printing apparatus transporting a sheet.

Description of the Related Art

In a printing apparatus disclosed in Japanese Patent Laid-Open No. 2014-156088, it is possible to separate a driven roller from a transport roller and a paper discharge roller at the time of removing sheets jammed in a transport path. In the printing apparatus described in Japanese Patent Laid-Open No. 2014-156088, the driven roller is moved to a position abutting on or separated from the transport roller and the paper discharge roller by moving a release rod.

In the printing apparatus of Japanese Patent Laid-Open No. 2014-156088, when a user performs jam processing, the user is required to directly move the release rod by inserting hands into an internal space of the device. The latest printing apparatus has been downsized, and thus, the internal space of the device has been narrowed. For this reason, there is a case where it is difficult for the user to move the release rod.

SUMMARY OF THE INVENTION

An object of the invention is to provide a printing apparatus enabling a user to easily perform jam processing.

In one aspect of the present invention, there is provided a printing apparatus comprising a printing unit; a cassette in which a plurality of sheets to be printed are stored, and which is capable of being drawn out from the apparatus; a roller pair which is capable of being in an abutting state and a separate state, and transports a sheet supplied from the cassette in the abutting state; and a mechanism which changes the roller pair from the abutting state to the separate state as the cassette is drawn out.

According to the invention, a roller pair is changed from an abutting state to a separate state only by drawing out a cassette, and thus, it is possible for a user to easily perform jam processing.

Further features of the present invention will become apparent from the following description of exemplary embodiments with reference to the attached drawings.

DESCRIPTION OF THE EMBODIMENTS

Hereinafter, an example of a printing apparatus according to the invention will be described in detail with reference to the attached drawings. First, a first embodiment of the printing apparatus according to the invention will be described with reference to FIG. 1A to FIG. 5D.

First Embodiment

Figure 1A:
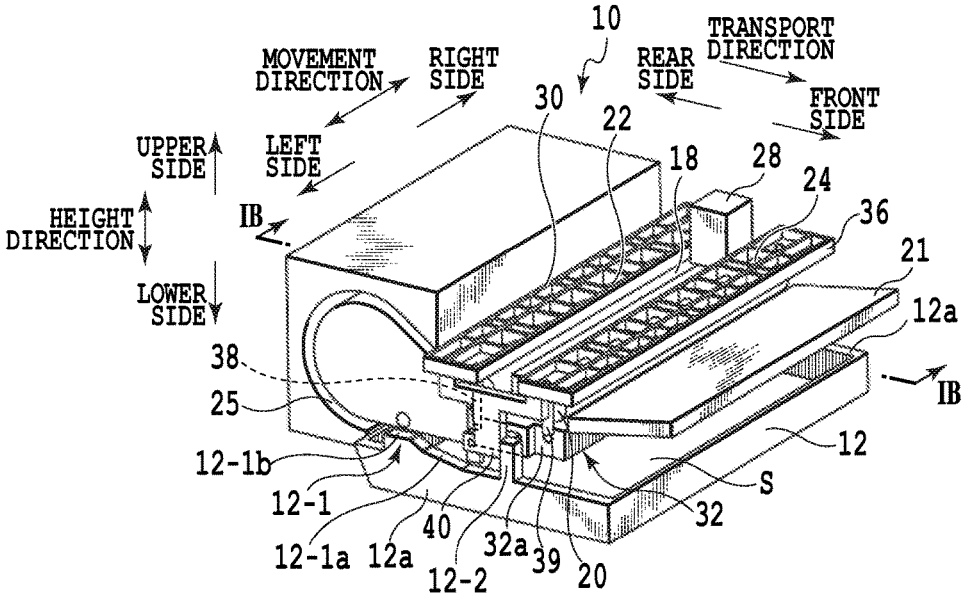
FIG. 1A is a schematic configuration perspective view of a main part of a printing apparatus according to the invention.
Figure 1B:
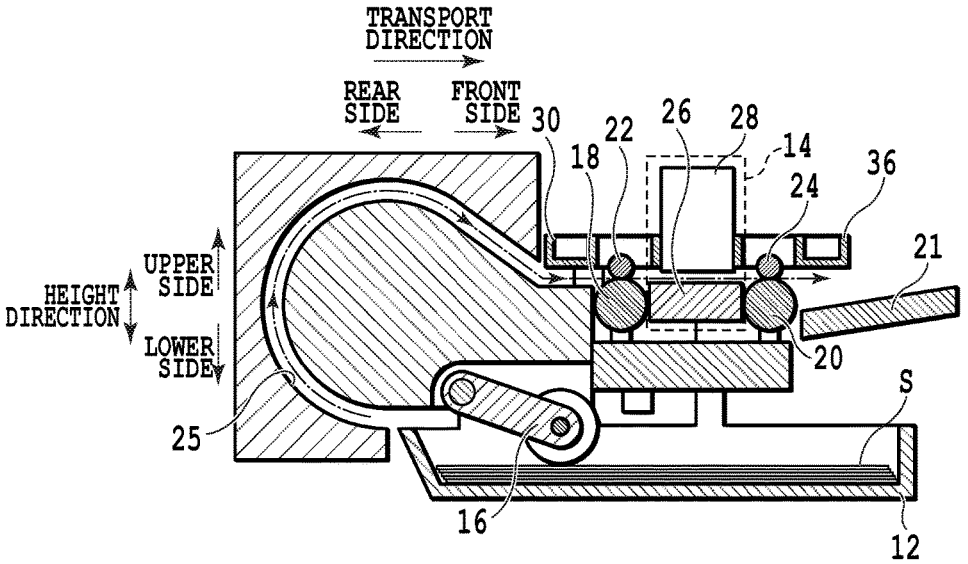
FIG. 1B is a sectional view taken along line IB-IB of FIG. 1A.

As illustrated in FIG. 1A, in a printing apparatus 10 according to a first embodiment of the invention, unused sheets S are stored (contained), and a cassette-like paper feeding tray 12 (also referred to as a paper feeding cassette) which can be loaded and unloaded (drawn out and inserted) is disposed on the front side. In addition, as illustrated in FIG. 1B, a printing unit 14 performing printing with respect to the sheet S to be transported is disposed on the upper side of the paper feeding tray 12. In addition, the printing apparatus 10 includes a feeding roller 16 feeding the sheet S in the paper feeding tray 12, a transport roller 18 (drive roller) transporting the fed sheet S to a printing unit 14, and a discharge roller 20 (drive roller) discharging the printed sheet S in the printing unit 14. The transport roller 18 and the discharge roller 20 respectively transport the sheet S in a transport direction (an arrow direction illustrated by a dashed-dotted line in FIG. 1B) by interposing the sheet S between pinch rollers 22 and 24 (driven rollers). Then, the sheet S on the uppermost position, which is contained in the paper feeding tray 12, is fed by the feeding roller 16 through a curved passage 25. After that, the sheet S is transported in the transport direction, and is discharged and mounted (stacked) onto a paper discharge tray 21, by the transport roller 18 and the discharge roller 20. Furthermore, the entire operation of the printing apparatus 10 is controlled by a controller 60.

The printing unit 14 includes a platen 26 supporting the sheet S to be transported, and a printing head 28 ejecting ink with respect to the sheet S in an ink jet system. The printing head 28 is mounted on a reciprocating carriage (not illustrated). As for the printing head 28, a lower surface (an eject port surface) on which a nozzle array (an eject port array) of ink is formed is disposed to face the platen 26. Furthermore, the carriage reciprocates in a direction intersecting with the transport direction. Then, the printing head 28 reciprocates in the direction intersecting with the transport direction through the carriage and performs serial printing, with respect to the sheet S to be transported in the transport direction.

A part of the paper feeding tray 12 contains the sheet S before being transported, and a raised portion 12-1 for abutting on an abutting member 46 (described below) is formed on the rear sides of upper end portions of right and left side walls 12*a*. The raised portion 12-1 includes a tilted portion 12-1*a* upwardly tilted from the front side to the rear side, and a flat portion 12-1*b* formed to be flat on an upper end. In addition, an erecting portion 12-2 erected approximately in the center position is formed on the side wall 12*a*. Furthermore, the erecting portion 12-2 is formed to be longer than the raised portion 12-1 in a height direction.

The transport roller 18 is disposed on the upstream side (the rear side) of the printing unit 14 in the transport direction, and the pinch roller 22 supported on a support member 30 is disposed on the upper side. A roller pair formed of the transport roller 18 and the pinch roller 22 can be in an abutting state and a separate state. A plurality of pinch rollers 22 are arranged side by side in a position facing the transport roller 18 in the support member 30, along a movement direction of the printing head (hereinafter, simply referred to as a "movement direction"). The support member 30 is connected to a center wall 32 disposed on the lower side of the printing unit 14 and the upper side of the paper feeding tray 12 by a biasing portion 38, in the vicinity of both end portions in the movement direction. Furthermore, the biasing portion 38 constantly biases the support member 30 to the lower side. Accordingly, the pinch roller 22 abuts on the transport roller 18 while being pressed by a biasing force of the biasing portion 38, through the support member 30. In addition, the support member 30 is moved up and down by a lift unit 40 (up-and-down unit). Accordingly, in a case where the support member 30 is moved up, the pinch roller 22 is separated from the transport roller 18, and thus, is in the separate state, and in a case where the support member 30 is moved down, the pinch roller 22 abuts on the transport roller 18, and thus, is in the abutting state.

The discharge roller 20 is disposed on the downstream side (the front side) of the printing unit 14 in the transport direction, and the pinch roller 24 supported on a support member 36 is disposed on the upper side to abut on or to be separated from the discharge roller 20. That is, a roller pair formed of the discharge roller 20 and the pinch roller 24 can be in the abutting state and the separate state. A plurality of pinch rollers 24 are arranged side by side in a position facing the discharge roller 20 in the support member 36, along the movement direction. The support member 36 is connected to the center wall 32 by a biasing portion 39, in the vicinity of both end portions in the movement direction. Furthermore, the biasing portion 39 constantly biases the support member 36 to the lower side by a biasing force which is approximately coincident with that of the biasing portion 38. Accordingly, the pinch roller 24 abuts on the discharge roller 20 while being pressed by the biasing force of the biasing portion 39, through the support member 36. In addition, the support member 36 is moved up and down by the lift unit 40 (described below). Accordingly, in a case where the support member 36 is moved up, the pinch roller 24 is separated from the discharge roller 20, and in a case where the support member 36 is moved down, the pinch roller 24 abuts on the discharge roller 20. Furthermore, the support members 30 and 36 are supported to be moved up and down by a guide mechanism (not illustrated).

The lift units 40 are disposed on two side surfaces 32*a* (a right side surface and a left side surface) intersecting with a movement direction in the center wall 32. Furthermore, the lift units 40 disposed on two side surfaces 32*a* are identical to each other except that the configurations thereof are reversed in the movement direction (reversed in a right-and-left direction), and thus, in the following description, only the lift unit 40 disposed on the side surface 32*a* on the left side will be described.

Figure 2A:
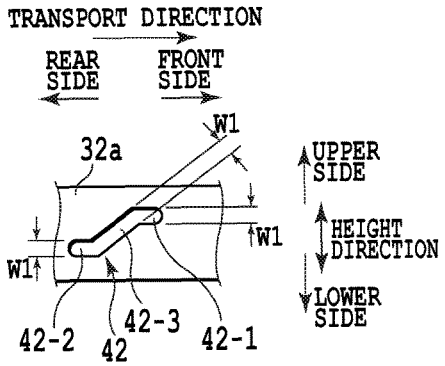
FIG. 2A is an explanatory diagram illustrating a guide groove of a printing apparatus of a first embodiment.

Guide grooves 42 are formed on two side surfaces 32*a*. As illustrated in FIG. 2A, in the guide groove 42, an end portion region 42-1 on the front side and an end portion region 42-2 on the rear side extend in the transport direction, and the end portion region 42-1 and the end portion region 42-2 are coupled together by a connection region 42-3. For this reason, the connection region 42-3 is formed to be tilted towards the front upper side. Furthermore, the end portion regions 42-1 and 42-2 and the connection region 42-3 are respectively formed to have a width W1.

Figure 2B:
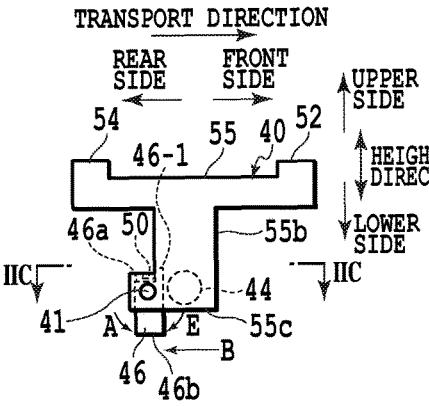
FIG. 2B is an explanatory diagram illustrating an lift unit in which an abutting member is in an abutting position.

The lift unit 40 is moved up and down in what is guided by the guide groove 42 on the side surface 32*a*. As illustrated in FIG. 2B, the lift unit 40 is formed approximately in the shape of T, and includes a sliding member 55 including sliding surfaces 52 and 54 on the front side and the rear side of an upper end. Then, a protrusion 44 and an abutting member 46 are disposed on the lower side of the sliding member 55. As illustrated in FIG. 2C, the protrusion 44 is formed on a side surface 55*a* of the sliding member 55 facing the side surface 32*a*. The protrusion 44 has a diameter which is approximately coincident with the width W1 of the guide groove 42 and can be inserted to the guide groove 42. Then, when the lift unit 40 is disposed on the center wall 32, the protrusion 44 is inserted to the guide groove 42. Furthermore, the protrusion 44 may be configured not to be easily detached from the guide groove 42. Specifically the protrusion 44 may be configured by a screw having a screw head of which the diameter is larger than the width W1 in tip portion 44*a*.

The end portion region 42-1 is formed in a height position where when the protrusion 44 is positioned, the erecting portion 12-2 is capable of abutting on the front surface 55*b* of the sliding member 55 and a tip portion 46*b* of the abutting member 46 in an abutting position and the flat portion 12-1*b* at the time of loading and unloading the paper feeding tray 12 abut on each other. Furthermore, in the description of the first embodiment, the height position of the lift unit 40 when the protrusion 44 is positioned in the end portion region 42-1 will be suitably referred to as an "upper position". In addition, the abutting position is a position in which when the lift unit 40 is positioned on the lowermost side of the center wall 32 (a lower position described below), the abutting member 46 is capable of abutting on the raised portion 12-1 at the time of loading and unloading the paper feeding tray 12. That is, the abutting position indicates that the abutting member 46 is positioned within a movement region which is a region where the paper feeding tray 12 is moved, and specifically, is a position in the lift unit 40, illustrated in FIG. 2B.

In addition, the end portion region 42-2 is formed in a height position where when the protrusion 44 is positioned, the tip portion 46*b* of the abutting member 46 in the abutting position is on the lower side from the flat portion 12-1*b* at the time of loading and unloading the paper feeding tray 12. Further, the sliding member 55 and the abutting member 46 in a retracted position are formed in a height position where the sliding member 55 and the abutting member 46 do not abut on the raised portion 12-1 at the time of loading and unloading the paper feeding tray 12. Furthermore, in the description of the first embodiment, the height position of the lift unit 40 when the protrusion 44 is positioned in the end portion region 42-2 will be suitably referred to as a "lower position". In addition, the retracted position is a position in which when the lift unit 40 is in the lower position, the abutting member 46 avoids the abutting with respect to the raised portion 12-1 at the time of loading and unloading the paper feeding tray 12. That is, the retracted position indicates that the abutting member 46 is positioned out of the movement region of the paper feeding tray 12, and specifically, is a position in the lift unit 40, illustrated in FIG. 2D. In the printing apparatus 10, the lift unit 40 is controlled such that the lift unit 40 is positioned in the lower position at the time of starting and ending a printing operation.

In addition, the abutting member 46 is disposed on the rear side of the protrusion 44 in the transport direction to be rotated around an axis 41 which extends in the movement direction. The abutting member 46 is constantly biased in the direction of an arrow A by a biasing portion 48, and is rotated in the direction of an arrow E by the driving member 45. Furthermore, a protruding portion 46-1 is formed on an end surface 46*a* of the abutting member 46 facing the tip portion 46*b*, and the protruding portion 46-1 abuts on the abutting portion 50 formed in the sliding member 55. That is, the abutting member 46 is biased in the direction of the arrow A by a biasing force of the biasing portion 48, but the protruding portion 46-1 abuts on the abutting portion 50, and thus, the rotation in the direction of the arrow A is restricted. Then, a position in which the rotation is restricted becomes the abutting position, and at this time, the tip portion 46*b* is positioned on the lower side from a lower end portion 55*c* of the sliding member 55 by a predetermined length. According to such a configuration, in a case where the abutting member 46 is pressed in the direction of an arrow B at the time of being positioned in the abutting position, the abutting member 46 is rotated in the direction of an arrow E against the biasing force of the biasing portion 48. Then, in a case where the abutting member 46 is not pressed in the direction of the arrow B, the abutting member 46 returns to the abutting position by the biasing force of the biasing portion 48.

Figure 2D:
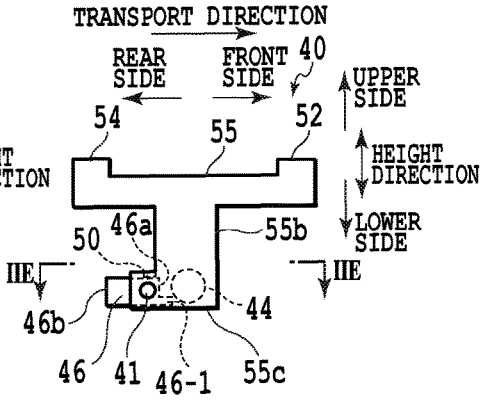
FIG. 2D is an explanatory diagram illustrating the lift unit in which the abutting member is in a retracted position.
Figure 2C:
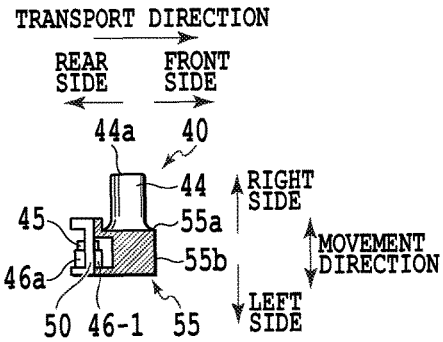
FIG. 2C is a sectional view taken along line IIC-IIC of FIG. 2B.
Figure 2E:
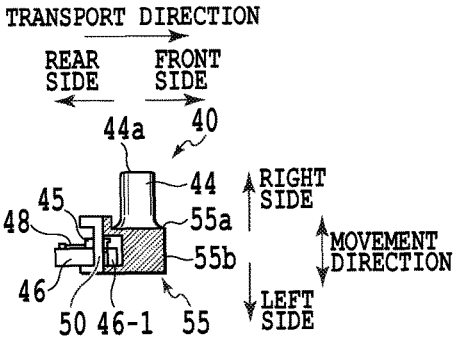
FIG. 2E is a sectional view taken along line IIE-IIE of FIG. 2D.

The abutting member 46 is retracted by being rotated in the direction of the arrow E by the driving member 45, and as illustrated in FIG. 2D and FIG. 2E, is rotated to the retracted position. Then, in a case where the abutting member 46 is rotated to the retracted position, the abutting member 46 is fixed in the retracted position by a fixation portion (not illustrated). Then, in a case where the fixation of the fixation portion is released, the abutting member 46 returns to the abutting position by the biasing force of the biasing portion 48. Thus, for example, when the abutting member 46 is rotated to the retracted position, the fixation portion fixes the abutting member 46 against the biasing force of the biasing portion 48 by engaging with the protruding portion 46-1. Then, when the fixation is released, the driving member 45 is rotated in the direction of the arrow A, and thus, the engagement with respect to the protruding portion 46-1 is released.

When the lift unit 40 is disposed on the center wall 32, the sliding surface 54 slidably abuts on a lower surface of the support member 30. In addition, when the lift unit 40 is disposed on the center wall 32, the sliding surface 52 slidably abuts on a lower surface of the support member 36. For this reason, in a case where the lift unit 40 is moved up, the sliding surface 54 presses up the support member 30 while sliding on the lower surface of the support member 30, and the sliding surface 52 presses up the support member 36 while sliding on the lower surface of the support member 36. Accordingly, the pinch roller 22 is separated from the transport roller 18, and the pinch roller 24 is separated from the discharge roller 20. Accordingly, when the lift unit 40 is positioned in the lower position, the pinch rollers 22 and 24 respectively abut on the transport roller 18 and the discharge roller 20, and when the lift unit 40 is positioned in the upper position, the pinch rollers 22 and 24 are respectively separated from the transport roller 18 and the discharge roller 20.

When the lift unit 40 is positioned in the lower position, and the abutting member 46 is positioned in the abutting position (refer to FIG. 5A and FIG. 5C), the lift unit 40 is moved up as the paper feeding tray 12 is drawn out. That is, according to the movement of the paper feeding tray 12 in the direction of an arrow G, first, the abutting member 46 abuts on the tilted portion 12-1*a*. At this time, the rotation of the abutting member 46 in the direction of the arrow A is restricted by the abutting portion 50, and thus, a state is maintained in which the abutting member 46 abuts on the tilted portion 12-1*a*. Then, according to further movement of the paper feeding tray 12 in the direction of the arrow G, the tilted portion 12-1*a* presses up the sliding member 55 through the abutting member 46, and the protrusion 44 is moved from the end portion region 42-2 to the connection region 42-3. Accordingly, the lift unit 40 is moved up against the biasing force of the biasing portions 38 and 39. Then, in a case where the abutting member 46 reaches the flat portion 12-1*b*, the protrusion 44 is positioned in the end portion region 42-1, and the lift unit 40 is moved to the upper position (refer to FIG. 5B and FIG. 5D).

In addition, when the lift unit 40 is positioned to the upper position, and the paper feeding tray 12 is inserted, the lift unit 40 is moved down. That is, according to the movement of the paper feeding tray 12 in the direction of an arrow F, first, the erecting portion 12-2 abuts on the front surface 55*b* of the sliding member 55, and presses the sliding member 55 to the direction of an arrow H. Then, according to further movement of the paper feeding tray 12 in the direction of the arrow F, the protrusion 44 is moved from the end portion region 42-1 to the connection region 42-3, and moves the sliding member 55. Thus, the lift unit 40 is moved down according to the movement of the sliding member 55, the biasing force of the biasing portions 38 and 39, and the like. After that, in a case where the paper feeding tray 12 is inserted to a position in which the feeding of the feeding roller 16 can be performed (hereinafter, referred to as a "feeding position"), the protrusion 44 is positioned in the end portion region 42-2, and the lift unit 40 is moved to the lower position. Thus, in this embodiment, a mechanism changing the roller pair to be in the abutting state or the separate state is configured of the raised portion 12-1, the lift unit 40, the support members 30 and 36, and the like.

Figure 3A:
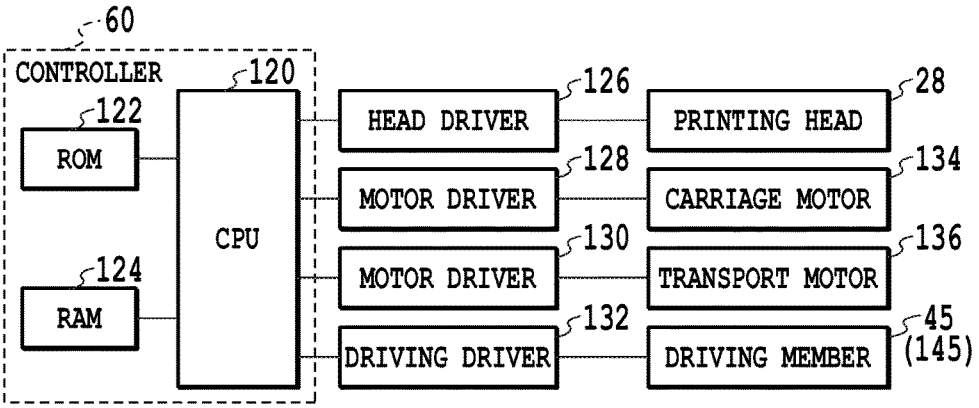
FIG. 3A is a block configuration diagram illustrating a hardware configuration of a main part of the printing apparatus.

In addition, as illustrated in FIG. 3A, in the printing apparatus 10, control processing, data processing, or the like of the operation of the printing apparatus 10 is executed by a center processing device (CPU) 120. A ROM 122 storing a predetermined program for executing the entire operation or various processing through a bus, is connected to the CPU 120. In addition, a RAM 124 as a working area, in which various registers or the like required for executing the program by the CPU 120 are set, is connected to the CPU 120. In the printing apparatus 10, the controller 60 is configured of the CPU 120, the ROM 122, and the RAM 124. Further, a head driver 126, motor drivers 128 and 130, and a driving driver 132 are connected to the CPU 120. The printing head 28 is connected to the head driver 126. A carriage motor 134 for reciprocating the carriage in the movement direction is connected to the motor driver 128. A transport motor 136 is connected to the motor driver 130, and the transport roller 18 and the discharge roller 20 are driven by the transport motor 136. The driving member 45 is connected to the driving driver 132.

Figure 3B:
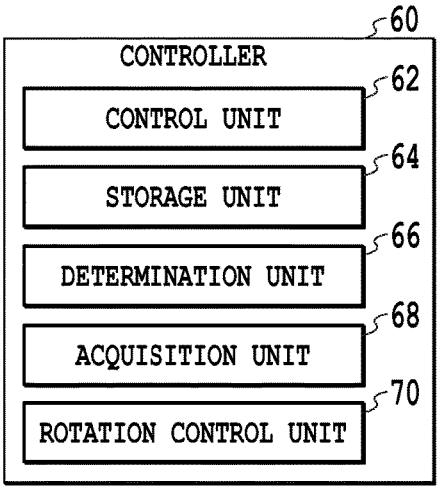
FIG. 3B is a block configuration diagram illustrating a functional configuration of a controller.

Next, a functional configuration of the controller 60 will be described. As illustrated in FIG. 3B, the controller 60 includes a control unit 62 controlling each constituent in the printing operation, a recovery operation, or the like, and a storage unit 64 storing various data items such as image data to be printed. Further, the controller 60 includes a determination unit 66 determining whether or not the sheet S is transported, an acquisition unit 68 acquiring a signal based on a determination result of the determination unit 66, and a rotation control unit 70 rotating the abutting member 46 by the driving member 45 on the basis of the signal acquired in the acquisition unit 68.

In order to determine whether or not the sheet S is transported, the determination unit 66 determines whether or not the printing operation is started on the basis of an instruction from the user, and determines whether or not the printing operation based on the instruction is ended. In addition, the determination unit 66, for example, monitors sensing result of a sensor (not illustrated) sensing the sheet S, which is disposed on the curved passage 25, or a torque value of a motor (not illustrated) driving the transport roller 18 and the discharge roller 20, and determines whether or not a paper jam occurs. That is, in the printing operation with respect to a plurality of sheets, the printing operation is started, and then, in a case where the sheet is not capable of being sensed within a certain period of time, it is determined that the paper jam occurs. In addition, in a case where the torque value of the motor (not illustrated) is greater than or equal to a predetermined value, it is determined that the paper jam occurs. Then, in a case where it is determined that the printing operation is started, a signal representing that the sheet S is transported to the acquisition unit 68 is output. In addition, in a case where it is determined that the printing operation is ended, and the paper jam occurs, a signal representing that the sheet S is not transported to the acquisition unit 68 is output.

The rotation control unit 70 monitors the acquisition unit 68, and in a case where the signal representing that the sheet S is transported to the acquisition unit 68 is output, the rotation control unit 70 rotates the abutting member 46 from the abutting position to the retracted position. In addition, in a case where the signal representing that the sheet S is not transported to the acquisition unit 68 is output, the rotation control unit releases the fixation of the fixation portion (not illustrated). Accordingly, the abutting member 46 is rotated from the retracted position to the abutting position by the biasing force of the biasing portion 48.

Figures 4A, 4B, 4C, 4D:
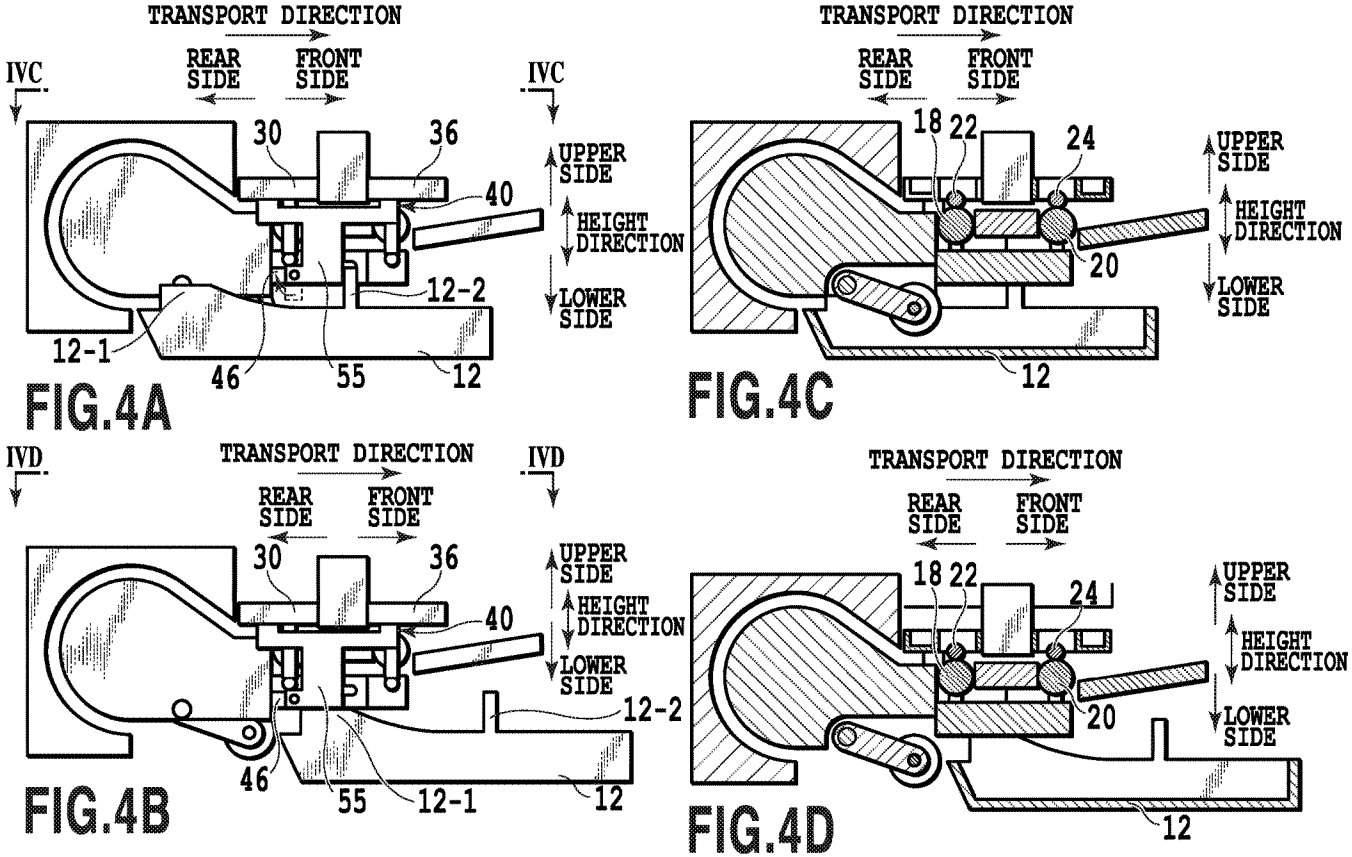
FIG. 4A and FIG. 4B are explanatory diagrams illustrating a relationship between a paper feeding tray and the lift unit during a printing operation.
FIG. 4C is a sectional view taken along line IVC-IVC of FIG. 4A.
FIG. 4D is a sectional view taken along line IVD-IVD of FIG. 4B.

In the above configuration, in a case where the printing operation is started by the printing apparatus 10, the determination unit 66 determines that the printing operation is started, and as illustrated in FIG. 4A, the abutting member 46 positioned in the abutting position is rotated to the retracted position by the rotation control unit 70, on the basis of the determination result. Accordingly, even in a case of loading and unloading the paper feeding tray 12 during the printing operation, as illustrated in FIG. 4B, the raised portion 12-1 does not abut on the abutting member 46, and thus, the lift unit 40 is not moved up. That is, the moving up of the lift unit 40 is restricted, and thus, the moving up of the pinch rollers 22 and 24 is restricted. Accordingly, as illustrated in FIG. 4C and FIG. 4D, a state is maintained in which the pinch rollers 22 and 24 respectively abut on the transport roller 18 and the discharge roller 20. For this reason, even in a case of loading and unloading the paper feeding tray 12 during the printing operation, the pinch roller 22 and the transport roller 18, and the pinch roller 24 and the discharge roller 20 are not separated from each other, and thus, it is possible to perform printing without any transport failure of the sheet S.

Figure 5A:
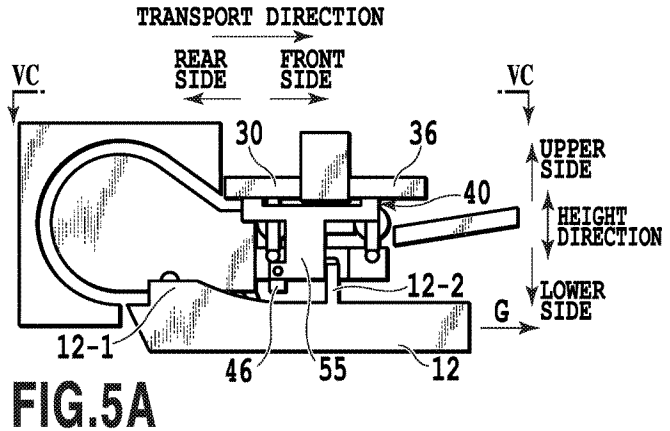
FIG. 5A and FIG. 5B are explanatory diagrams illustrating a relationship between the paper feeding tray and the lift unit after the printing operation and when a paper jam occurs.
Figure 5C:
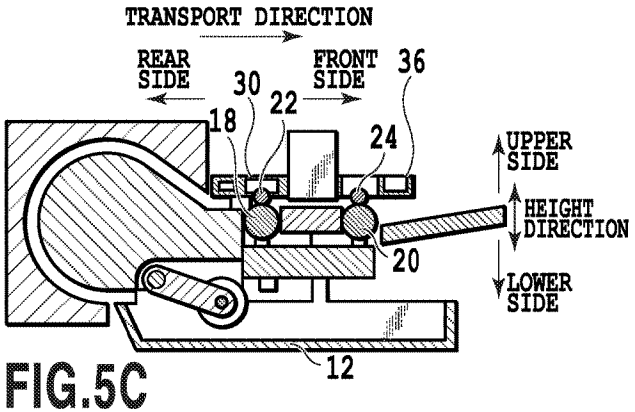
FIG. 5C is a sectional view taken along line VC-VC of FIG. 5A.
Figure 5B:
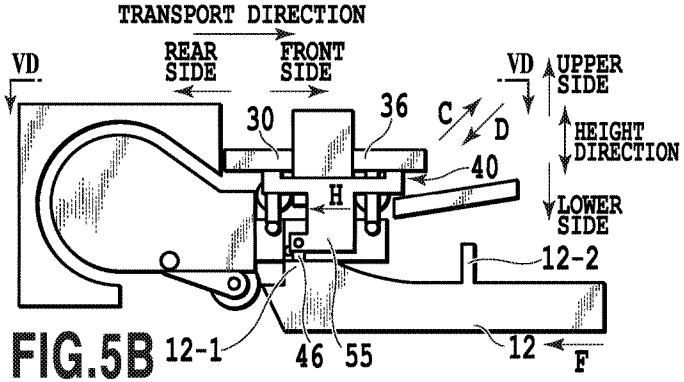
Figure 5D:
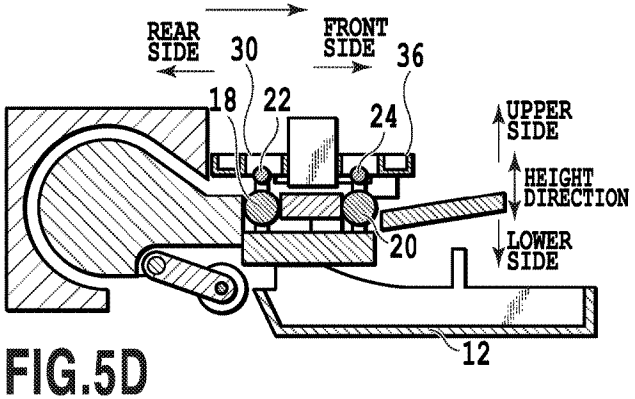
FIG. 5D is a sectional view taken along line VD-VD of FIG. 5B.

After that, in a case where the determination unit 66 determines that the paper jam occurs during the printing operation, the driving of the feeding roller 16, the transport roller 18, and the discharge roller 20 is stopped by the control unit 62. In addition, as illustrated in FIG. 5A, the abutting member 46 is rotated from the retracted position to the abutting position by the rotation control unit 70. Then, in a case where the user draws out the paper feeding tray 12 in order to perform a jam processing operation removing a paper jam, the abutting member 46 abuts on the tilted portion 12-1*a*. At this time, the lift unit 40 is moved in the direction of an arrow C along the guide groove 42 as the paper feeding tray 12 is moved in the direction of the arrow G and the abutting member 46 is pressed up by the raised portion 12-1. Then, as illustrated in FIG. 5B, in a case where the abutting member 46 is positioned in the flat portion 12-1*b*, the lift unit 40 is moved up to the upper position. Furthermore, in a case where the lift unit 40 is moved up, the sliding surfaces 52 and 54 respectively press up the lower surface of the support member 30 and the lower surface of the support member 36 to the upper side while sliding the lower surfaces. Accordingly, as illustrated in FIG. 5D, the pinch rollers 22 and 24 are respectively separated from the transport roller 18 and the discharge roller 20. That is, pinch rollers 22 and 24 are moved in separate directions, and thus, are pinch-released. Furthermore, in a case where the lift unit 40 is moved up to the upper position, such a state is maintained until the front surface 55*b* is pressed in the direction of the arrow H by the erecting portion 12-2.

Thus, the user performs the jam processing operation in a state where the pinch rollers 22 and 24 are respectively separated from the transport roller 18 and the discharge roller 20. Then, in a case where the operation is ended, the paper feeding tray 12 is inserted. In a case where the paper feeding tray 12 is moved in the direction of the arrow F, the erecting portion 12-2 abuts on the front surface 55*b* of the sliding member 55. Then, the lift unit 40 is moved in the direction of the arrow D (refer to FIG. 5B) along the guide groove 42, according to the movement of the paper feeding tray 12 in the direction of the arrow F, the biasing force of the biasing portions 38 and 39, or the like. Then, in a case where the paper feeding tray 12 reaches the feeding position, as illustrated in FIG. 5C, the lift unit 40 is moved down to the lower position, the pinch roller 22 abuts on the transport roller 18, and the pinch roller 24 abuts on the discharge roller 20. That is, the pinch rollers 22 and 24 are moved in an abutting direction. After that, for example, it is sensed that the paper feeding tray 12 is inserted to the feeding position, and thus, it is sensed that the jam processing operation is completed, and the printing operation is restarted.

In addition, in a state where the paper feeding tray 12 is drawn out, in a case where the lift unit 40 is in the lower position, the abutting member 46 is in the abutting position, and the paper feeding tray 12 is inserted, the abutting member 46 is rotated by being pressed against the raised portion 12-1, and thus, the paper feeding tray 12 can be easily inserted.

As described above, the printing apparatus 10 according to this embodiment is provided with the lift unit 40 for moving up and down the support members 30 and 36 which support pinch rollers 22 and 24. The lift unit 40 includes the abutting member 46, and the raised portion 12-1 of the paper feeding tray 12 abuts on the abutting member 46. In addition, the erecting portion 12-2 which is capable of abutting on the lift unit 40, is disposed in the paper feeding tray 12. Then, in a case where the printing operation is started, the abutting member 46 is rotated to the retracted position, and the printing operation is ended, and in a case where a paper jam occurs (that is, when the sheet S is not transported), the abutting member 46 is rotated to the abutting position.

Accordingly, in the printing apparatus 10, even in a case of loading and unloading the paper feeding tray 12 during the printing operation (during a transport operation of the sheet), the abutting member 46 does not abut on the raised portion 12-1. For this reason, even in a case where the user carelessly draws out the paper feeding tray 12 during the printing operation, the lift unit 40 is not moved up, and a pinch state is maintained in which the pinch rollers 22 and 24, the transport roller 18, and the discharge roller 20 abut on each other. Accordingly, the transport failure of the sheet S does not occur.

In addition, in a case where the paper jam occurs, the user only draws out the paper feeding tray 12 in order to perform the jam processing operation, and the pinch (the abutting state) of two roller pairs is automatically released (the separate state) in conjunction with the drawing out operation. Accordingly, the user is not required to perform pinch-release by inserting hands into an internal space or the like of the printing apparatus 10 at the time of performing the jam processing operation, and thus, it is possible to reduce a burden on the user.

Second Embodiment

Next, a second embodiment of the printing apparatus according to the invention will be described with reference to FIG. 6A to FIG. 10B. Furthermore, in the following description, the same reference numerals are used in the same or the corresponding configurations as those of the printing apparatus 10 described above, and the detailed description will be suitably omitted.

A printing apparatus 100 according to a second embodiment is different from the printing apparatus 10 described above in that a lift unit 140 is configured to be moved up and down according to the operation of the paper feeding tray 12 and a paper discharge tray 121. That is, in the printing apparatus 100, the lift units 140 are disposed on two side surfaces 32*a* (the right side surface and the left side surface) intersecting with the movement direction in the center wall 32. Furthermore, lift units 140 disposed on two side surfaces 32*a* are identical to each other except that the configurations thereof are reversed in the movement direction (reversed in the right-and-left direction), and thus, in the following description, only the lift unit 140 disposed on the side surface 32*a* on the left side will be described.

Figure 6A:
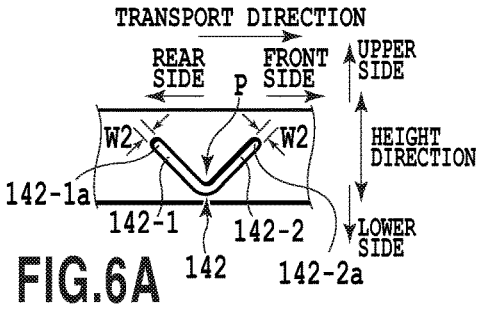
FIG. 6A is an explanatory diagram illustrating a guide groove of a printing apparatus of a second embodiment.

As illustrated in FIG. 6A, approximately V-shaped guide grooves 142 are formed on two side surfaces 32*a*. The guide groove 142 includes a tilt region 142-1 tilted to the front lower side on the rear side, and a tilt region 142-2 tilted to the front upper side on the front side. The tilt regions 142-1 and 142-2 are respectively formed to have a width W2. The lift unit 140 is guided by the guide groove 142 and is disposed on the side surface 32*a* to be moved up and down. As illustrated in FIG. 6B, the lift unit 140 is formed approximately in the shape of T, and includes a sliding member 155 including the sliding surfaces 52 and 54 on the front side and the rear side of an upper end. Then, a protrusion 144 is disposed on the lower side of the sliding member 155. In addition, an abutting portion 104 is disposed approximately in the center position of the sliding member 155. The abutting portion 104 includes an abutting member 146 abutting on the raised portion 12-1, and an abutting member 147 abutting on a push-up member 102 (described below) disposed on the paper discharge tray 121. Furthermore, the erection portion 12-2 is not disposed in the paper feeding tray 12.

Figure 6D:
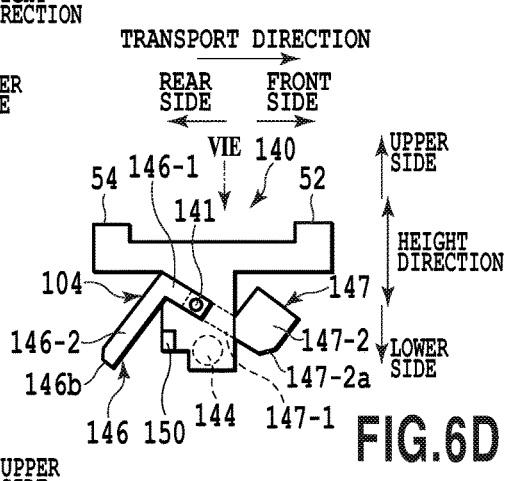
FIG. 6D is an explanatory diagram illustrating the lift unit in which the abutting portion is in a retracted position.
Figure 6B:
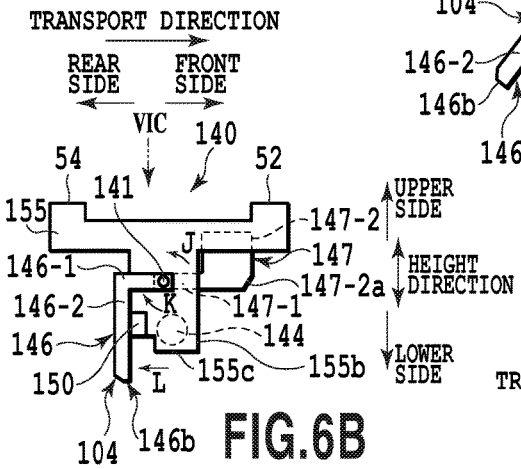
FIG. 6B is an explanatory diagram illustrating a lift unit in which an abutting portion is in an abutting position.
Figure 6C:
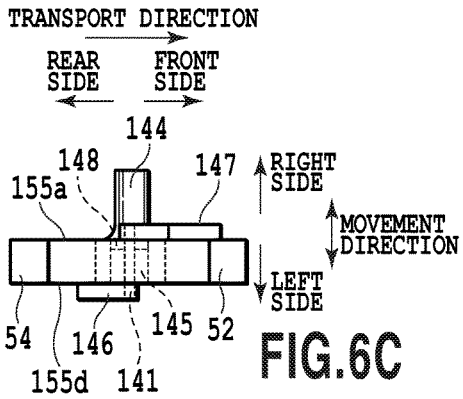
FIG. 6C is a diagram viewed in an arrow VIC direction of FIG. 6B.

As illustrated in FIG. 6C, the protrusion 144 is formed on a side surface 155*a* of the sliding member 155 facing the side surface 32*a*. The protrusion 144 has a diameter which is approximately coincident with the width W2 of the guide groove 42 and can be inserted to the guide groove 142. Then, when the lift unit 140 is disposed on the center wall 32, the protrusion 144 is inserted to the guide groove 142. Furthermore, the protrusion 144 may be configured not to be easily detached from the guide groove 142. Specifically the protrusion 144 may be configured by a screw having a screw head of which the diameter is larger than the width W2 in tip portion 144*a*.

When the protrusion 144 is positioned in a rear end portion 142-1*a*, the tilt region 142-1 is formed such that the push-up member 102 is capable of entering the lower side of the abutting member 147. Further, a tip portion 146*b* of the abutting member 146 in the abutting position is formed to be higher than or equal to the height position of the flat portion 12-1*b* at the time of loading and unloading the paper feeding tray 12. In addition, when the protrusion 144 is positioned in a front end portion 142-2*a*, the tilt region 142-2 is formed such that the push-up member 102 is capable of entering the lower side of the abutting member 147. Further, a tip portion 146*b* of the abutting member 146 in the abutting position is formed to be higher than or equal to the height position of the flat portion 12-1*b* at the time of loading and unloading the paper feeding tray 12. Furthermore, in the description of the second embodiment, the height position of the lift unit 140 when the protrusion 144 is positioned in the rear end portion 142-1*a* or the front end portion 142-2*a* will be suitably referred to as an "upper position".

In addition, when the protrusion 144 is positioned on a coupling point P between the tilt regions 142-1 and 142-2, the tilt regions 142-1 and 142-2 are formed such that the tip portion 146*b* of the abutting member 146 in the abutting position is positioned on the lower side from the flat portion 12-1*b* at the time of loading and unloading the paper feeding tray 12. In addition, when the push-up member 102 is moved and abuts on the abutting member 147, the push-up member 102 is formed in a height position in which a cutout portion 102*c* (described below) and a cutout portion 147-2*a* (described below) abut on each other. Further, the abutting members 146 and 147 and the sliding member 155 in the retracted position do not abut on the raised portion 12-1 at the time of loading and unloading the paper feeding tray 12, and are formed in a position in which the abutting member 147 is not pressed up by the push-up member 102. Furthermore, in the description of the second embodiment, the height position of the lift unit 140 when the protrusion 144 is positioned on a connection point P will be suitably referred to as a "lower position". In addition, in the printing apparatus 100, the lift unit 140 is controlled such that the lift unit 140 is positioned in the lower position at the time of starting or ending the printing operation.

In addition, the abutting position is a position in which when the lift unit 140 is positioned in the lower position, the abutting member 146 abuts on the raised portion 12-1 at the time of loading and unloading the paper feeding tray 12, and the abutting member 147 is pressed up by the push-up member 102, and thus, the lift unit 140 can be moved up. That is, the abutting position is a position indicating that the abutting portion 104 is positioned within a movement region of the paper feeding tray 12 and the push-up member 102, and specifically, is a position in the lift unit 140, illustrated in FIG. 6B. In addition, the retracted position is a position in which when the lift unit 140 is in the lower position, the abutting member 146 does not abut on the raised portion 12-1 at the time of loading and unloading the paper feeding tray 12, and the moving up of the lift unit 140 is avoided. Further, the retracted position is a position in which the abutting member 147 is not pressed up by the push-up member 102, and the moving up of the lift unit 140 is avoided. That is, the retracted position is a position indicating that the abutting portion 104 is positioned out of the movement region of the paper feeding tray 12 and the push-up member 102, and specifically, is a position in the lift unit 140, illustrated in FIG. 6D. In addition, the sliding surfaces 52 and 54 are moved up and down as the lift unit 140 is moved up and down, and thus, the support members 30 and 36 are moved up and down. For this reason, when the lift unit 140 is positioned in the lower position, the pinch rollers 22 and 24 respectively abut on the transport roller 18 and the discharge roller 20, and when the lift unit 140 is positioned in the upper position, the pinch rollers 22 and 24 are respectively separated from the transport roller 18 and the discharge roller 20.

In addition, in the abutting portion 104, the abutting member 147 is disposed on the side surface 155*a* of the sliding member 155, and the abutting member 146 is disposed on a side surface 155*d* facing the side surface 155*a*. Then, the abutting member 146 and the abutting member 147 are configured to be rotated in conjunction with each other. That is, the abutting member 146 is disposed approximately in the center position of the sliding member 155 to be rotated around an axis 141 which extends in the movement direction. In addition, the abutting member 146 is formed approximately in the shape of L, and one end portion side thereof is fixed to the axis 141. The abutting member 146 includes a short edge portion 146-1 extending from one end portion to the rear side, and a long edge portion 146-2 curvedly extending to the lower side.

The other end portion side of the abutting member 147 is fixed to the axis 141, and the abutting member 147 is disposed to be rotated around the axis 141. The abutting member 147 includes an extension portion 147-1 extending from the other end portion side to the front side, and a rectangular portion 147-2 extending from extension portion 147-1 to the upper side with a predetermined width. Furthermore, a corner portion of the rectangular portion 147-2 on the front lower side is cut out, and thus, the cutout portion 147-2*a* is formed. In addition, the extension portion 147-1 is formed to be parallel to the short edge portion 146-1.

The abutting portion 104 is constantly biased in the direction of an arrow J by a biasing portion 148, and is rotated in the direction of an arrow K by a driving member 145. Furthermore, a protruding portion 150 is formed on the side surface 155*d*, and the abutting member 146 is formed such that the long edge portion 146-2 is capable of abutting on the protruding portion 150. That is, the abutting members 146 and 147 are biased in the direction of the arrow J by a biasing force of the biasing portion 148, but the long edge portion 146-2 abuts on the protruding portion 150, and thus, the rotation in the direction of the arrow J is restricted. Then, a position where the rotation is restricted becomes the abutting position, and the tip portion 146*b* is positioned on the lower side from a lower end portion 155*c* of the sliding member 155 by a predetermined length. In a case where the abutting portion 104 is pressed in the direction of an arrow L at the time of being positioned in the abutting position, the abutting portion 104 is rotated in the direction of the arrow K against the biasing force of the biasing portion 148. Then, in a case where the abutting portion 104 is not pressed in the direction of the arrow L, the abutting portion 104 returns to the abutting position by the biasing force of the biasing portion 48.

Figure 6E:
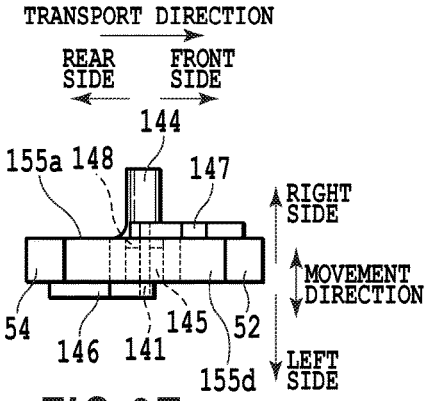
FIG. 6E is a diagram viewed in an arrow VIE direction of FIG. 6D.

The abutting portion 104 is rotated in the direction of the arrow K by the driving member 145, and as illustrated in FIG. 6D and FIG. 6E, is rotated to the retracted position. Then, in a case where the abutting portion 104 is moved to the retracted position, the abutting portion 104 is fixed in the retracted position by the fixation portion (not illustrated), and in a case where the fixation is released, the abutting portion 104 returns to the abutting position by the biasing force of the biasing portion 148.

Figure 7A:
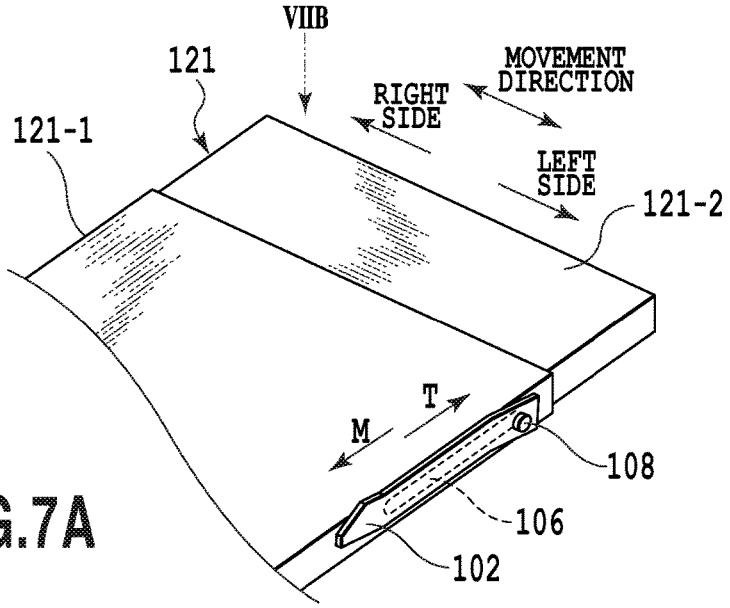
FIG. 7A is a schematic configuration perspective view of a paper discharge tray.
Figure 7B:
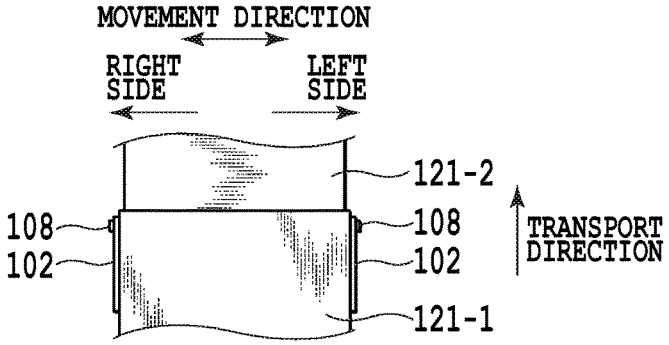
FIG. 7B is a diagram viewed in an arrow VIIB direction.
Figure 7C:
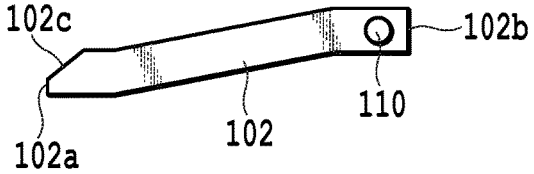
FIG. 7C is a schematic configuration diagram of a push-up member.

As illustrated in FIG. 7A, the paper discharge tray 121 on which the sheets S after being transported are stacked, includes a storage member 121-2 which is stored in a base member 121-1 to be loaded and unloaded. In addition, the push-up member 102 for pressing up the abutting member 147 is movably disposed on a side surface of the base member 121-1. As illustrated in FIG. 7C, the push-up member 102 includes the cutout portion 102*c* including a cutout surface which is capable of abutting on a cutout surface of the cutout portion 147-2*a*, on one end portion 102*a*. A hole 110 is formed on the other end portion 102*b* side to which the screw 108 is inserted. In addition, an elongated hole 106 is formed on the side surface of the base member 121-1 to extend in an extension direction of the side surface. Then, as illustrated in FIG. 7B, the push-up member 102 is fixed to the storage member 121-2 by the screw 108 through the elongated hole 106. At this time, the positions of one end portions 102*a* of the push-up members 102 disposed on the left side and the right side are coincident with each other in the transport direction.

Figure 10A:
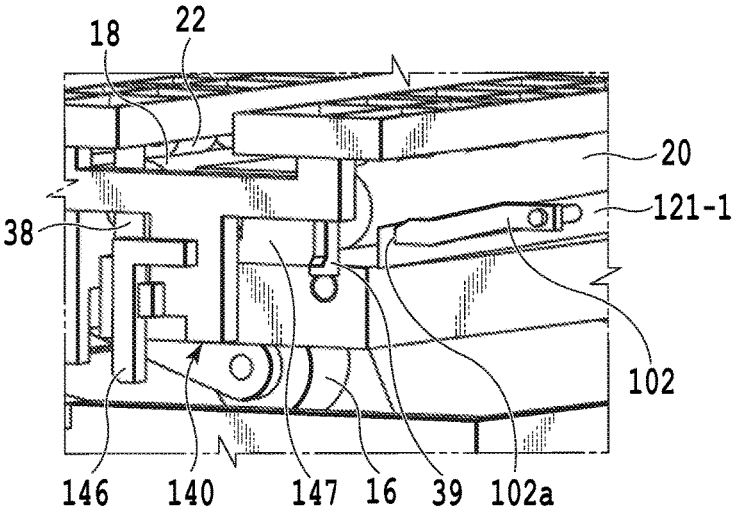
FIG. 10A and FIG. 10B are explanatory diagrams illustrating moving up of the lift unit by the push-up member.
Figure 10B:
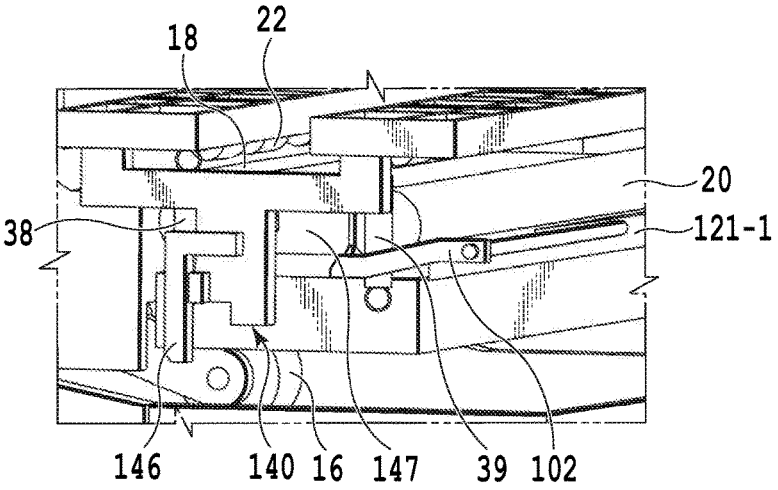

Furthermore, when the push-up member 102 is fixed by the screw 108, the push-up member 102 is moved in the direction of an arrow M, and thus, the fixation is performed such that the cutout surfaces of the cutout portion 102*c* and the cutout portion 147-2*a* abut on each other. Accordingly, in the push-up member 102, when the storage member 121-2 is drawn out from the base member 121-1, as illustrated in FIG. 10A, one end portion 102*a* is positioned by being separated from the abutting member 147 in the abutting position. When the storage member 121-2 is inserted to the base member 121-1, first, the cutout surface of the cutout portion 102*c* abuts on the cutout surface of the cutout portion 147-2*a* according to the movement of the push-up member 102 in the direction of the arrow M. After that, the push-up member 102 presses up the abutting member 147 according to further movement of the push-up member 102 in the direction of the arrow M, and as illustrated in FIG. 10B, one end portion 102*a* side enters the lower side of the abutting member 147. Thus, in this embodiment, a mechanism changing the roller pair to be in the abutting state or the separate state is configured of the raised portion 12-1, the push-up member 102, the lift unit 140, the support members 30 and 36, and the like.

Figure 8A:
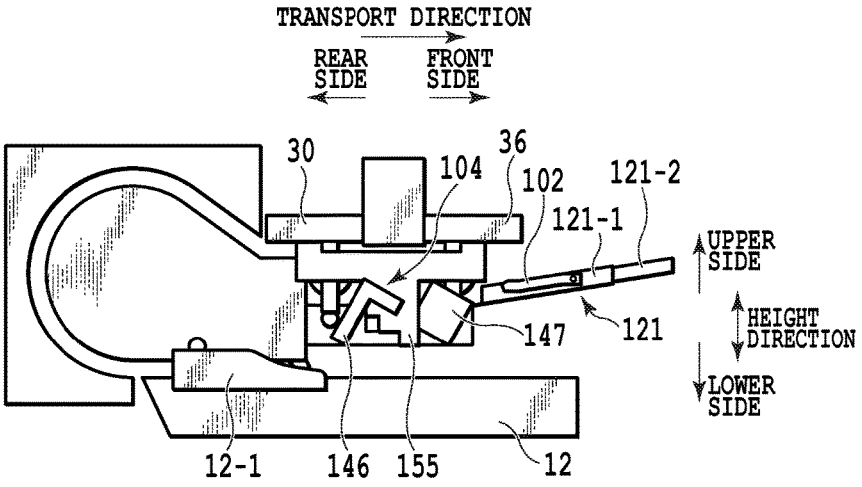
FIG. 8A and FIG. 8B are explanatory diagrams illustrating a relationship between a paper feeding tray and the lift unit during a printing operation.
Figure 8B:
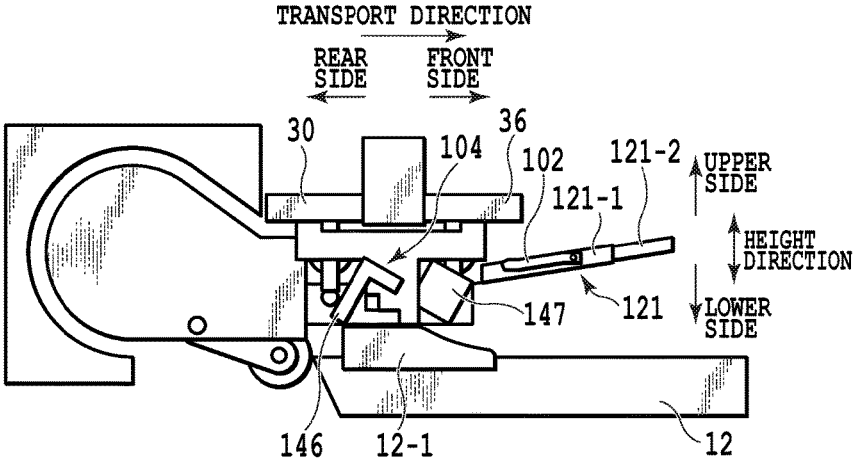

In the above configuration, in a case where the printing operation is started by the printing apparatus 100, the determination unit 66 determines that the printing operation is started, and as illustrated in FIG. 8A, the abutting portion 104 positioned in the abutting position is rotated to the retracted position by the rotation control unit 70, on the basis of the determination result. Accordingly, even in a case of loading and unloading the paper feeding tray 12 during the printing operation, as illustrated in FIG. 8B, the raised portion 12-1 does not abut on the abutting members 146 and 147 or the sliding member 155. Further, even in a case of inserting the storage member 121-2 to the base member 121-1 during the printing operation, the push-up member 102 is not capable of pressing up the abutting member 147. That is, the abutting portion 104 is rotated to the retracted position, and thus, the moving up of the lift unit 140 is restricted, and the moving up of the pinch rollers 22 and 24 is restricted. Accordingly, a state is maintained in which the pinch rollers 22 and 24 respectively abut on the transport roller 18 and the discharge roller 20. For this reason, even in a case of loading and unloading the paper feeding tray 12 or the storage member 121-2 of the paper discharge tray 121 during the printing operation, the pinch roller 22 and the transport roller 18, and the pinch roller 24 and the discharge roller 20 are not separated from each other. Accordingly, it is possible to perform printing without any transport failure of the sheet S.

Figure 9A:
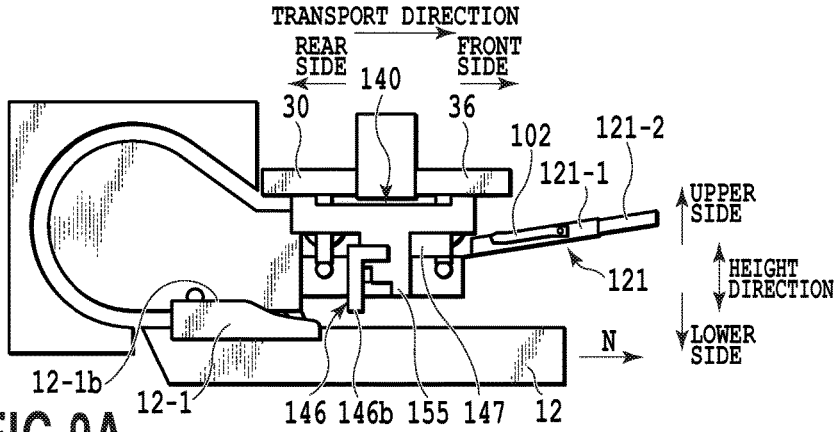
FIG. 9A, FIG. 9B, and FIG. 9C are explanatory diagrams illustrating a relationship in the paper feeding tray, the paper discharge tray, and the lift unit after the printing operation and when a paper jam occurs.
Figure 9B:
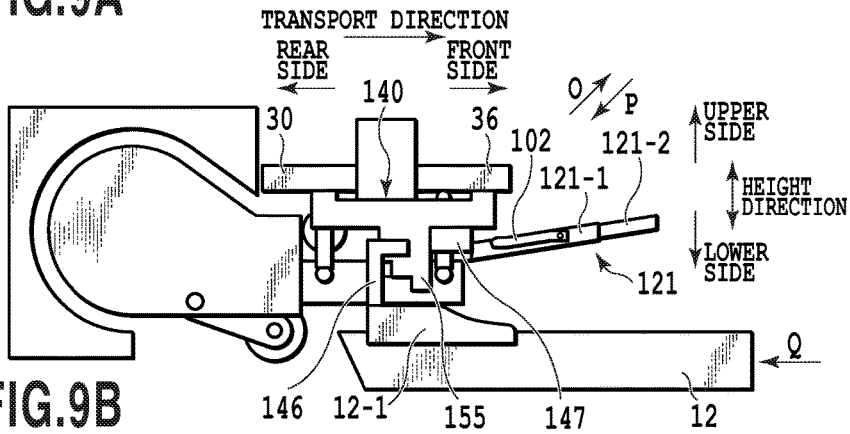

After that, in a case where the determination unit 66 determines that the paper jam occurs during the printing operation, the driving of feeding roller 16, the transport roller 18, and the discharge roller 20 is stopped by the control unit 62. In addition, as illustrated in FIG. 9A, the abutting portion 104 is rotated from the retracted position to the abutting position by the rotation control unit 70. Here, the user draws out the paper feeding tray 12 or the paper discharge tray 121 from a device main body, and thus, is able to separate the pinch rollers 22 and 24 from the transport roller 18 and the discharge roller 20. In a case of the paper feeding tray 12, first, the user draws out paper feeding tray 12 forward. Then, the abutting member 146 abuts on the tilted portion 12-1*a*. At this time, the lift unit 140 is moved in the direction of the arrow O along the guide groove 142 as the paper feeding tray 12 is moved in the direction of an arrow N and the abutting member 146 is pressed up by the raised portion 12-1. Then, as illustrated in FIG. 9B, in a case where the abutting member 146 is positioned in the flat portion 12-1*b*, the lift unit 140 is moved up to the upper position. Accordingly, the pinch rollers 22 and 24 are respectively separated from the transport roller 18 and the discharge roller 20. Furthermore, in a case where the lift unit 140 is maintained in the upper position, the paper feeding tray 12 is drawn out partway, and the flat portion 12-1*b* abuts on the tip portion 146*b*. Alternatively, the lift unit 140 is moved up to the upper position, and then, the storage member 121-2 of the paper discharge tray 121 is inserted to the base member 121-1, and thus, the push-up member 102 enters the lower side of the abutting member 147. In this case, it is possible to entirely draw out the paper feeding tray 12.

Thus, in a state where the pinch rollers 22 and 24 are respectively separated from the transport roller 18 and the discharge roller 20, the user performs the jam processing operation. Then, in a case where the operation is ended, the paper feeding tray 12 is inserted to the feeding position. In a case where the lift unit 140 is maintained in the upper position without using the push-up member 102, the paper feeding tray 12 is moved in the direction of an arrow Q, and the lift unit 140 is moved down to the lower position. At this time, the lift unit 140 is moved in the direction of an arrow P by the biasing force of the biasing portions 38 and 39. In addition, in a case where the lift unit 140 is maintained in the upper position by using the push-up member 102, the paper feeding tray 12 is moved in the direction of the arrow Q, and the storage member 121-2 is drawn out from the base member 121-1, and thus, the push-up member 102 is pulled out from the lower side of the abutting member 147. Furthermore, any one of the movement of the paper feeding tray 12 and the drawing out of the storage member 121-2 may be executed first. Accordingly, the lift unit 140 is moved in the direction of the arrow P by the biasing force or the like of the biasing portions 38 and 39, and is moved down to the lower position. After that, it is sensed that the transport roller 18, the discharge roller 20, and the pinch rollers 22 and 24 abut on each other, and thus, it is sensed that the jam processing operation is completed, and the printing operation is restarted.

Figure 9C:
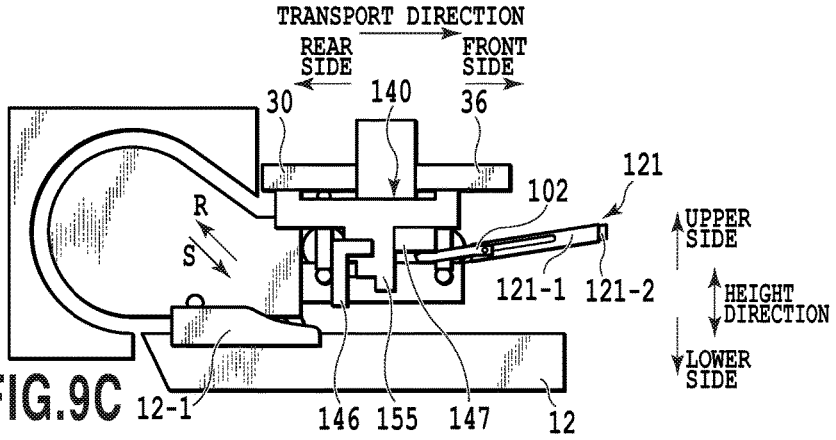

In addition, in a case of the paper discharge tray 121, first, the storage member 121-2 is inserted to the base member 121-1. Then, the push-up member 102 is moved in the direction of the arrow M, and the cutout surface of the cutout portion 102*c* abuts on the cutout surface of the cutout portion 147-2*a*, and as illustrated in FIG. 9C, the push-up member 102 presses up the abutting member 147, and thus, enters the lower side of the abutting member 147. Accordingly, the lift unit 140 is moved in the direction of an arrow R, and is moved up to the upper position, and thus, the pinch rollers 22 and 24 are respectively separated from the transport roller 18 and the discharge roller 20. Furthermore, the lower side of the lift unit 140, which is moved up, is supported on the push-up member 102, and thus, it is possible to maintain the upper position.

After that, the user draws out the paper feeding tray 12, as necessary, and performs the jam processing operation, and in a case where the operation is ended, the paper feeding tray 12 is inserted to the feeding position. Then, the storage member 121-2 is drawn out from the base member 121-1, and thus, the push-up member 102 is moved in the direction of an arrow T, and is pulled out from the lower side of the abutting member 147. Accordingly, the lift unit 140 is moved in the direction of an arrow S by the biasing force or the like of the biasing portions 38 and 39, and is moved down to the lower position. After that, for example, it is sensed that the transport roller 18, the discharge roller 20, and the pinch rollers 22 and 24 abut on each other, and thus, it is sensed that the jam processing operation is completed, and the printing operation is restarted.

In addition, in a state where the paper feeding tray 12 is drawn out, in a case where the lift unit 140 is in the lower position, the abutting portion 104 is in the abutting position, and the paper feeding tray 12 is inserted, the abutting member 146 is rotated by the raised portion 12-1, and thus, the paper feeding tray 12 can be easily inserted.

As described above, the printing apparatus 100 according to this embodiment includes the lift unit 140 for moving up and down the support members 30 and 36 which support the pinch rollers 22 and 24. The lift unit 140 includes the abutting portion 104 including the abutting members 146 and 147, the raised portion 12-1 of the paper feeding tray 12 is capable of abutting on the abutting member 146, and the push-up member 102 of the paper discharge tray 121 is capable of abutting on the abutting member 147. Then, in a case where the printing operation is started, the abutting portion 104 is rotated to the retracted position, and the printing operation is ended, and in a case where a paper jam occurs (that is, when the sheet S is not transported), the abutting portion 104 is rotated to the abutting position.

Accordingly, in the printing apparatus 100, even in a case of loading and unloading the paper feeding tray 12 during the printing operation (during the transport operation of the sheet), the abutting member 46 does not abut on the raised portion 12-1. For this reason, even in a case where the user carelessly draws out the paper feeding tray 12 during the printing operation, the lift unit 140 is not moved up, and a state is maintained in which the pinch rollers 22 and 24, the transport roller 18, and the discharge roller 20 abut on each other. Accordingly, the transport failure of the sheet S does not occur. In addition, in a case where the paper jam occurs, the user only draws out the paper feeding tray 12 or inserts the storage member 121-2 in order to perform the jam processing operation, and thus, it is possible to separate the pinch rollers 22 and 24, the transport roller 18, and the discharge roller 20 from each other. Thus, according to this embodiment, in order to separate the pinch rollers 22 and 24, the transport roller 18, and the discharge roller 20 from each other, the user is not required to insert hands into the internal space or the like of the printing apparatus 10, and thus, it is possible to reduce a burden on the user. Further, in the printing apparatus 100, when the pinch rollers 22 and 24, the transport roller 18, and the discharge roller 20 are separated from each other, the use of the paper feeding tray 12 or the paper discharge tray 121 can be selected, and a freedom degree of a user operation is improved.

Modification Example

The above embodiments may be modified as follows.

(1) The arrangement position of the lift units 40 and 140 is not limited to the upper side of the paper feeding tray 12, and may be in any direction with respect to the paper feeding tray 12. Furthermore, in this case, a mechanism moving up and down the lift units 40 and 140 according to the loading and unloading of the paper feeding tray 12 is required. Then, in such a mechanism, when the sheet is transported during the printing operation or the like, the moving up and down of the lift units 40 and 140 is not capable of being executed. Further, when the sheet is not transported after the printing operation or when the paper jam occurs, the moving up and down of the lift units 40 and 140 is capable of being executed.

(2) The abutting member 46 and the abutting portion 104 are moved up and down, and thus, the abutting member 46 and the abutting portion 104 may be positioned in the abutting position and the retracted position.

(3) In the abutting portion 104, the abutting member 146 and the abutting member 147 are not in conjunction with each other, and the abutting member 146 and the abutting member 147 may be each independently rotated. In this case, the erecting portion 12-2 is disposed in the paper feeding tray 12, and when the paper feeding tray 12 is inserted, the lift unit 140 can be moved to the lower position. Further, the end portion region is disposed in the front end portion 142-2*a* of the tilt region 142-2, which extends to be parallel to the transport direction, and when the paper feeding tray 12 is drawn out, the lift unit 140 can be maintained in the upper position. In addition, the abutting portion 104 may be configured by only the abutting member 147. In this case, in the printing apparatus 100, the abutment and the separation of the pinch rollers 22 and 24, the transport roller 18, and the discharge roller 20 can be controlled by only the push-up member 102.

(4) The lift units 40 and 140 are moved up and down by the driving of the driving unit such as a motor, and a paper feeding tray not including the raised portion 12-1 or the erecting portion 12-2 is loaded and unloaded, and thus, the driving of the driving unit may be controlled, and the lift unit 40 may be moved up and down. In addition, in the lift unit 140, the storage member is loaded and unloaded in a paper discharge tray not including the push-up member 102, and thus, the driving of the driving unit may be controlled, and the lift unit 140 may be moved up and down. In this case, in a case where the determination unit 66 determines that the sheet is transported, the driving unit is not controlled according to the movement of the paper feeding tray or the paper discharge tray, and in a case where the determination unit 66 determines that the sheet is not transported, the driving unit is controlled according to the movement of the paper feeding tray or the paper discharge tray.

(5) The lift units 40 and 140 are moved in directions other than the lift direction, and thus, the pinch rollers 22 and 24 may abut on and may be separated from the transport roller 18 and the discharge roller 20. In this case, a mechanism moving the pinch rollers 22 and 24 in a direction where the pinch rollers 22 and 24, the transport roller 18, and the discharge roller 20 abut on or are separated from each other according to the movement of the lift units 40 and 140 is provided.

In each of the embodiments described above, when the paper feeding tray 12 is drawn out from the device main body, the paper feeding tray 12 may be entirely pulled out and detached from the device main body, or a terminal of the tray may remain on the device main body not to be detached therefrom. In addition, in order to change the roller pair formed of the driving roller (the transport roller and the discharge roller) and the pinch roller from the abutting state to the separate state, the driving roller may be moved without moving the pinch roller.

In addition, the invention is not limited to only a serial scan type printing apparatus. For example, the invention can be applied to a so-called line type printing apparatus using a printing head which is capable of ejecting ink over a width direction of the sheet to be transported. In addition, a printing system is not limited to an ink jet system, and may be other printing systems. For example, the invention can be applied to various printing apparatuses such as a laser printing apparatus or a dot impact printing apparatus. Further, the invention is not limited to the printing apparatus, and can be widely applied to a sheet processing device which transports a sheet and performs any processing with respect to the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-121239 filed Jun. 17, 2016, which is hereby incorporated by reference herein in its entirety.

What is claimed is:

1. A printing apparatus comprising:

a printing unit;

a cassette in which a plurality of sheets to be printed are stored, and which is capable of being drawn out from the apparatus;

a feeding roller which feeds a sheet stored in the cassette;

a roller pair which transports the sheet fed by the feeding roller to the printing unit, and is capable of being in an abutting state in which the sheet can be transported and a separate state in which the sheet cannot be transported; and a mechanism which changes the roller pair from the abutting state to the separate state as the cassette is drawn out.

2. The printing apparatus according to claim 1, wherein the mechanism changes the roller pair from the separate state to the abutting state as the cassette is inserted into the apparatus.

3. The printing apparatus according to claim 2, further comprising:

a discharge tray in which the sheets printed by the printing unit are stacked, wherein in a case in which the discharge tray is inserted into the apparatus, the roller pair is changed from the abutting state to the separate state.

4. The printing apparatus according to claim 2, wherein the mechanism comprises a lift unit on which one roller of the roller pair is supported, and an abutting member which is disposed on the lift unit, when the cassette is drawn out, the lift unit moves up as a part of the cassette presses the abutting member up whereby the roller pair changes to the separate state, and when the cassette is inserted, the lift unit moves down as the part of the cassette escapes from the abutting member whereby the roller pair changes to the abutting state.

5. The printing apparatus according to claim 4, wherein the mechanism retracts the abutting member so as not to abut on a part of the cassette while the sheet is transported by the roller pair.

6. The printing apparatus according to claim 1, further comprising:

another roller pair which discharges the sheet printed by the printing unit, and is capable of being in an abutting state in which the sheet can be transported and a separate state in which the sheet cannot be transported, wherein the mechanism changes the roller pair and the other roller pair from the abutting state to the separate state as the cassette is drawn out.

7. The printing apparatus according to claim 6, wherein the mechanism changes the roller pair and the other roller pair from the separate state to the abutting state as the cassette is inserted into the apparatus.

8. A printing apparatus comprising:

a printing unit;

a cassette in which a plurality of sheets to be printed are stored, and which is capable of being drawn out from the apparatus;

a feeding roller which feeds a sheet stored in the cassette; and a roller pair which transports the sheet fed by the feeding roller to the printing unit, and is capable of being in an abutting state in which the sheet can be transported and a separate state in which the sheet cannot be transported, wherein, the roller pair changes to the abutting state when the cassette is inserted into the apparatus, and the roller pair changes to the separate state when the cassette is drawn out from the apparatus.

9. A printing apparatus comprising:

a printing unit;

a cassette in which a plurality of sheets to be printed are stored, and which is capable of being drawn out from the apparatus;

a feeding roller which feeds a sheet stored in the cassette;

a first roller pair which transports the sheet fed by the feeding roller to the printing unit, and is capable of being in an abutting state in which the sheet can be transported and a separate state in which the sheet cannot be transported;

a second roller pair which discharges the sheet printed by the printing unit, and is capable of being in an abutting state in which the sheet can be transported and a separate state in which the sheet cannot be transported; and a mechanism which changes the second roller pair from the abutting state to the separate state as the cassette is drawn out.

10. The printing apparatus according to claim 9, wherein the mechanism changes the second roller pair from the separate state to the abutting state as the cassette is inserted into the apparatus.

11. The printing apparatus according to claim 10, further comprising:

a discharge tray in which the sheets printed by the printing unit are stacked, wherein in a case in which the discharge tray is inserted into the apparatus, the second roller pair is changed from the abutting state to the separate state.

12. The printing apparatus according to claim 10, wherein the mechanism comprises a lift unit on which one roller of the second roller pair is supported, and an abutting member which is disposed on the lift unit, when the cassette is drawn out, the lift unit moves up as a part of the cassette presses the abutting member up whereby the second roller pair changes to the separate state, and when the cassette is inserted, the lift unit moves down as the part of the cassette escapes from the abutting member whereby the second roller pair changes to the abutting state.

13. The printing apparatus according to claim 12, wherein the mechanism retracts the abutting member so as not to abut on the part of the cassette while the sheet is transported by the second roller pair.

* * * * *